US006685106B1

(12) United States Patent
van der Steur

(10) Patent No.: US 6,685,106 B1
(45) Date of Patent: Feb. 3, 2004

(54) PAINT SPRAYING DEVICE

(75) Inventor: Gunnar van der Steur, Chesapeake City, MD (US)

(73) Assignee: EFC Systems, Inc., Havre de Grace, MD (US)

( * ) Notice: Subject to any disclaimer, the term of this patent is extended or adjusted under 35 U.S.C. 154(b) by 0 days.

(21) Appl. No.: 09/723,990

(22) Filed: Nov. 28, 2000

(51) Int. Cl.[7] ..... B05B 1/28; B05B 1/00; B05B 5/00

(52) U.S. Cl. ..... 239/296; 239/291; 239/600; 239/690

(58) Field of Search ..... 239/296, 291, 239/299, 690, 690.1, 705, 706, 708, 600, 290, 71, 74, 414; 901/7, 43

(56) References Cited

U.S. PATENT DOCUMENTS

| | | | | | |
|---|---|---|---|---|---|
| 3,578,249 | A | | 5/1971 | Davis, Sr. | 239/296 |
| 3,791,579 | A | * | 2/1974 | Cowan | 239/3 |
| 3,900,163 | A | * | 8/1975 | Volker | 239/125 |
| 4,228,958 | A | | 10/1980 | Perry | 239/411 |
| 4,273,293 | A | * | 6/1981 | Hastings | 239/705 |
| 4,502,629 | A | | 3/1985 | McGhee et al. | 239/3 |
| 4,539,932 | A | * | 9/1985 | Vecellio | 118/697 |
| 4,660,771 | A | | 4/1987 | Chabert et al. | 239/694 |
| 4,767,057 | A | | 8/1988 | Degli et al. | 239/296 |
| 4,961,536 | A | | 10/1990 | Correard | 239/296 |
| 5,064,119 | A | | 11/1991 | Mellette | 239/8 |
| 5,090,623 | A | | 2/1992 | Burns et al. | 239/301 |
| 5,135,172 | A | | 8/1992 | Toth | 239/297 |
| 5,165,605 | A | | 11/1992 | Morita et al. | 239/296 |
| 5,178,330 | A | | 1/1993 | Rodgers | 239/300 |
| 5,209,405 | A | | 5/1993 | Robinson et al. | 239/296 |
| 5,249,746 | A | | 10/1993 | Kaneko et al. | 239/296 |
| 5,265,801 | A | * | 11/1993 | Larson | 239/290 |
| 5,613,637 | A | | 3/1997 | Schmon | 239/296 |
| 5,676,310 | A | * | 10/1997 | Hynds | 239/8 |
| 6,089,471 | A | * | 7/2000 | Scholl | 239/300 |

* cited by examiner

*Primary Examiner*—David D. Hwu
(74) *Attorney, Agent, or Firm*—Armstrong, Kratz, Quintos, Hanson & Brooks, LLP

(57) ABSTRACT

A device for spraying paint having a spring activated cartridge in a body. The flow of fan air, atomizing air and paint are controlled by pistons within the cartridge. The fan air and atomizing air exit the body through slots to provide high volume, low pressure. The fan air is distributed uniformly by a baffle flange within a guide ring. The fan air exiting the air cap passes through a conical opening. Compensating air is provided over the surface of the air cap for improved coating. Isolation rings for reduction of electrical leakage are integrally formed in the body.

19 Claims, 12 Drawing Sheets

PAINT SPRAYING DEVICE

FIELD OF THE INVENTION

The present invention relates to a paint spraying device and more particularly to a high volume, low pressure device to pattern shape the atomizing and fan air.

BACKGROUND OF THE INVENTION

Paint spray devices, or guns, were usually operated at high pressure to atomize the paint and to adjust the spray patterns due to the wide availability of high pressure air. However, the coating transfer efficiency was less than optimum at the high pressures and an undesirable amount of coating material was dispersed into the environment. This led to an increased use of high volume low pressure (HVLP) air operated spray guns due to improved coating transfer efficiency and decreased air pollution. Several approaches have been used to provide the low pressure air and also have high volume air flow. Some of these are disclosed in the following:

| U.S. Pat. No. | Inventor(s) |
|---|---|
| 5,064,119 | Mellette |
| 5,090,623 | Burns et al |
| 5,135,172 | Toth |
| 5,165,605 | Morita |
| 5,178,330 | Rogers |
| 5,209,405 | Robinson et al |
| 5,249,746 | Kaneko et al |

Also, variations have been proposed for the configuration of a cap to direct the flow of the fan air and the atomizing air to form the spray pattern of the paint as in the following:

| U.S. Pat. No. | Inventor(s) |
|---|---|
| 3,578,249 | Davis |
| 4,228,958 | Perry |
| 4,502,629 | McGhee et al |
| 4,660,771 | Chabert et al |
| 4,767,057 | Degli |
| 4,961,536 | Correard |
| 5,613,637 | Schmon |

However, there still remains a need for improved paint spraying devices, especially devices which can be used in electrostatic painting procedures.

BRIEF SUMMARY OF THE INVENTION

It is an object of the invention to provide a more efficient high volume low pressure device for spraying paint.

It is a further object to provide very compact device which has high access to confined areas when the device is attached to a robot arm.

In accordance with the teachings of the present invention, there is disclosed a device for spraying paint with a body having a first end and an opposite second end. A nozzle is attached to the first end of the body. Means are provided for introducing fan air and atomizing air into the body, and means are provided for controlling the flow of paint through the device. At least one slot for the atomizing air and at least one slot for the fan air are formed in the body for exiting of the respective atomizing air and fan air from the first end of the body such that low pressure air is applied to the paint and high volume atomized paint is provided by the device.

Further in accordance with the teachings of the present invention, there is disclosed a device for spraying paint with a body having a first end and an opposite second end. Means are provided for introducing fan air and atomizing air into the body. A replaceable cartridge is disposed in a center bore in the body, the cartridge having at least one piston, a needle valve, and at least one spring. Activation of the at least one spring moves the needle valve and the at least one piston to introduce paint, atomizing air and fan air into the device.

In another aspect, there is disclosed a device for spraying paint having a body connected to a nozzle, an air cap covering the nozzle, an air cap nut securing the air cap to the body and means for controlling the flow of paint, atomizing air and fan air through the body. An improvement provides means for directing a portion of the fan air between the air cap and the air cap nut such that fan air passes over an outer surface of the air cap and assists in directing the paint spray.

These and other objects of the present invention will become apparent from a reading of the following specification taken in conjunction with the enclosed drawings.

DESCRIPTION OF THE PREFERRED EMBODIMENTS

Figure 1:
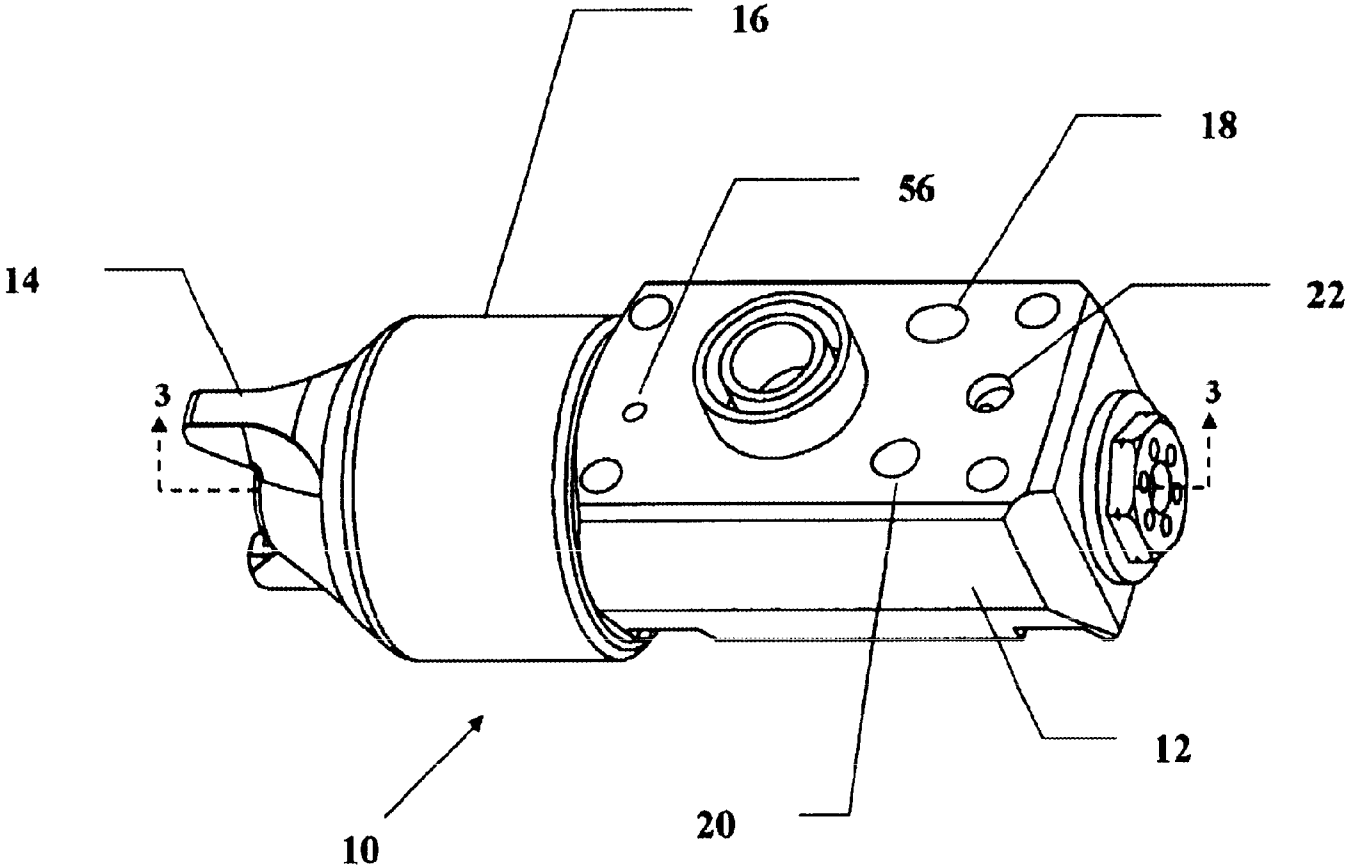
FIG. 1 is a perspective view of the device of the present invention.

Referring now to FIGS. 1–5, the present invention is a device 10 for spraying paint, especially for robot mounting which can be operated externally of the device and does not require manual activation or use by an operator. However, the present invention can also be used manually by an operator.

The device 10 has a body 12 and an air cap 14, the air cap 14 being threadingly attached to the first end of the body 12 via an air cap nut 16. Fan air is introduced into the second end of the body 12 through a fan air inlet 18. Atomizing air is introduced into the second end of the body 12 through an atomizing air inlet 20. The fan air and atomizing air volume and pressure are each controlled externally of the device by a flow regulator and/or a pressure regulator. The fan air and atomizing air are directed through the body 12 via ducts within the body 12 as will be described.

Trigger air is introduced into a trigger air inlet 22 to activate a cartridge. The cartridge has a housing 24, an outer piston 26, an outer piston spring 28, an inner piston 30, a cup seal 32, a needle spring 34, a trigger spring 36, an end cap 38, a piston clip 40, and O-rings on the inner piston 30. A needle valve 44 is disposed centrally in the inner piston 30 and is connected to the needle spring 34. A pair of spaced-apart O-ring seals 42' are disposed on the outer surface of the housing 24. A longitudinal bore 48 is formed in the body 12, extending the entire length of the body 12. The bore 48 has numerous steps, shoulders and threaded portions formed therein as will be described. The end cap 38 is threaded and is threadingly received in the bore 48 in the second end of the body 2. The outer piston 26 has an end distal from the cartridge and cap 38, the end of the outer piston being beveled and normally seated against a cooperating first shoulder formed in the bore 48.

When trigger air is introduced into the trigger air inlet 22, the cup seal 32 and inner piston 30 are forced against the trigger spring 36, compressing the trigger spring 36 and moving the inner piston 30 in a direction toward the end cap 38. As the inner piston 30 moves, the piston clip 40, mounted in the outer surface of the inner piston 30, engages the end of the outer piston 26 and unseats the beveled edge 46 of the end of the outer piston 26 from the shoulder in the bore. The outer piston spring 28 is compressed and the needle spring 34 is compressed to move the needle valve 44 in the direction of the end cap 38. The movement of the needle valve 44, inner piston 30 and outer piston 28 in the direction of the end cap controls the introduction of paint, fan air and atomizing air into the device as will be described.

Figure 4:
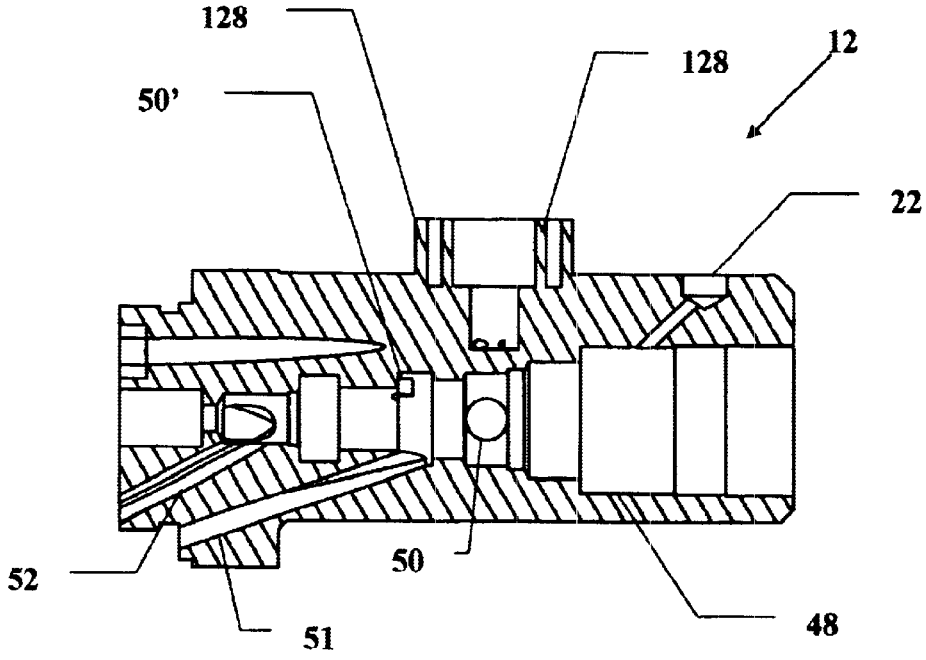
FIG. 4 is a cross-section showing one side of the body of the device with the cartridge removed.

The fan air inlet 18 is connected by a duct 50 to the bore 48 in the body, the duct 50 terminating approximately at the normal position of the outer piston 26 when no trigger air is introduced into the device 10. Fan air is prevented from flowing through the device 10 because of the seal formed by the beveled end 46 of the outer piston 26 with the shoulder in the bore and the seal formed by the O-ring around the outer surface of the housing 24. When the trigger air is introduced as explained above, the beveled end 46 is unseated and fan air flows (F with arrow) through the bore and into the diagonal duct 51 which extends downwardly to the second end of the body 12 (FIG. 4). A portion of the fan air is also directed upwardly into duct 50' which extends to the first end of the body 12.

Figure 5:
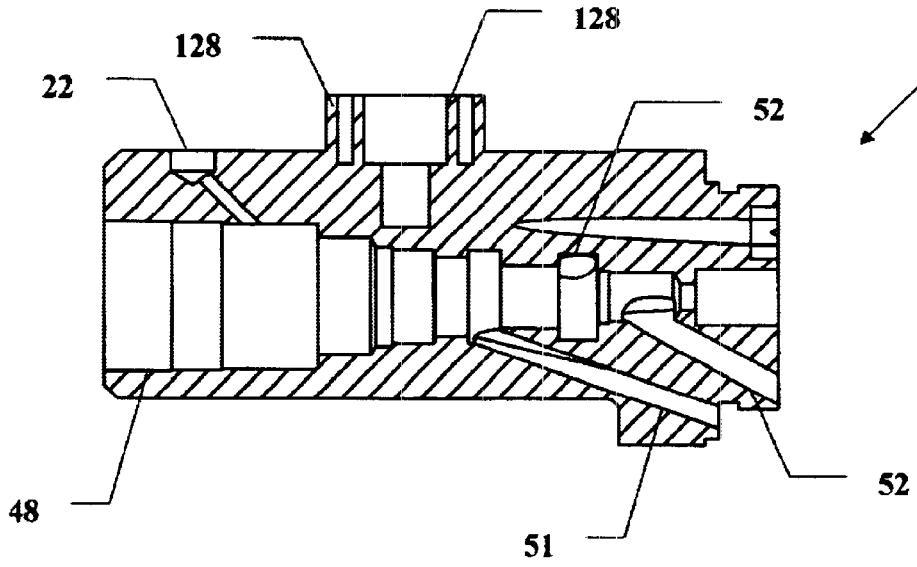
FIG. 5 is a cross-section showing the opposite side of the body of the device with the cartridge removed.

The atomizing air inlet 20 is connected to the bore 48 in the body through a duct 52 which communicates with the bore at a point opposite the end of the inner piston 30 adjacent to the beveled edge of the inner piston. The end 54 of the inner piston 30 is beveled and is seated against a second shoulder formed in the bore thereby preventing flow of atomizing air. The O-ring 42 on the inner piston 30 forms a seal with the bore and prevents atomizing air from flowing in the direction of the end cap. When the trigger air is introduced as explained above, the beveled end 54 of the inner piston 30 is unseated from the second shoulder and the atomizing air (A with arrow) enters the diagonal continuation of the atomizing air duct 52 which terminates at the second end of the body 12 (FIG. 5).

Figure 6:
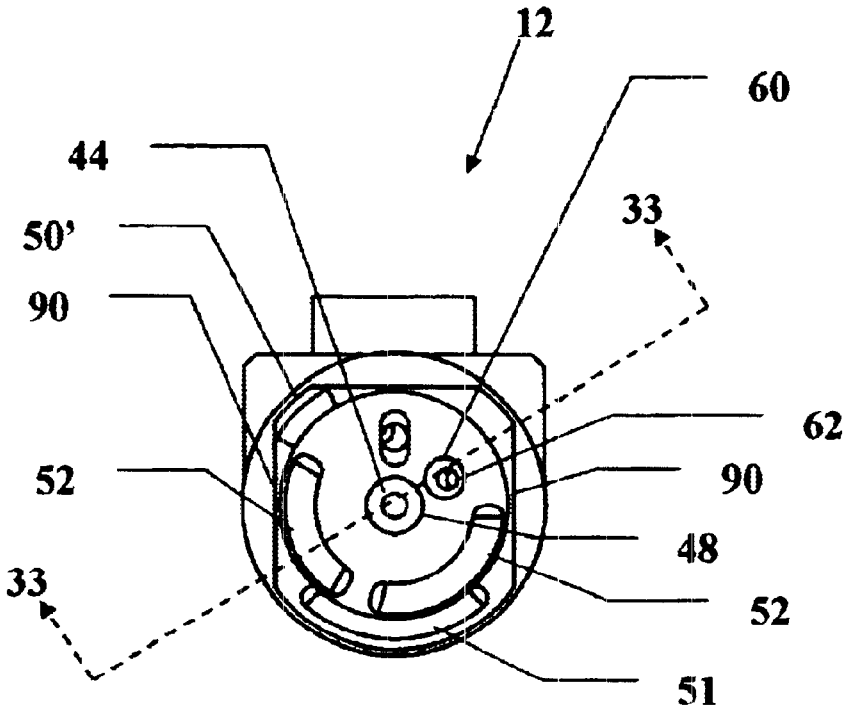
FIG. 6 is a front view of the first end of the body of the device.
Figure 8:
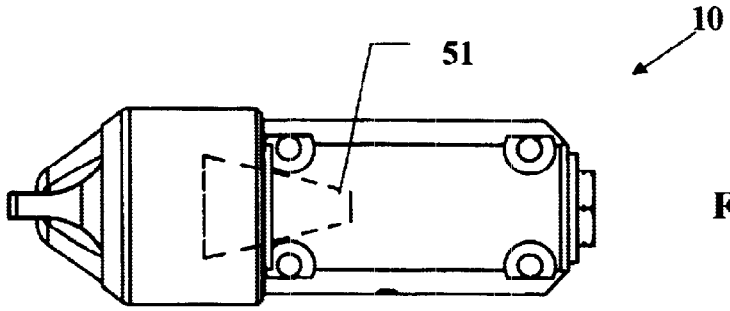
FIG. 8 is a bottom plan view of the device showing, in broken lines, the wedge-shaped fan air duct.
Figure 9:
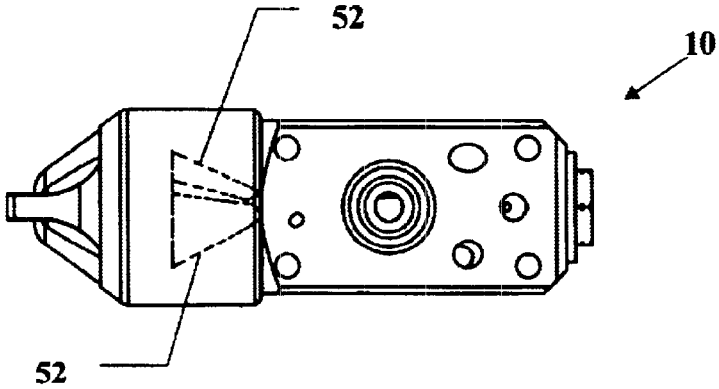
FIG. 9 is a top plan view of the device showing, in broken lines, the wedge-shaped atomizing air ducts.

As shown in FIG. 6, the ducts 51 and 50' for the fan air terminate as slots at the first end of the body 12. The upper duct 50' is angularly displaced from the lower duct 51. FIG. 8 shows the wedge-shaped duct 51 which distributes the fan air over a wide area and provides a high volume, low pressure supply of fan air. Similarly, the atomizing air exits from two slotted ducts 52 which are also wedge-shaped as shown in FIG. 9 and distribute the atomizing air over a wide area. The location of the slots for both the atomizing air and the fan air is determined primarily so as not to interfere with other internal passages within the body (e.g., paint, air ducts, electronics). The atomizing air was further made into two slots because a single continuous slot creates a weakened area. The angular orientation of the slots with respect to each other and with respect to the horizontal and vertical plane are not critical.

Figure 7:
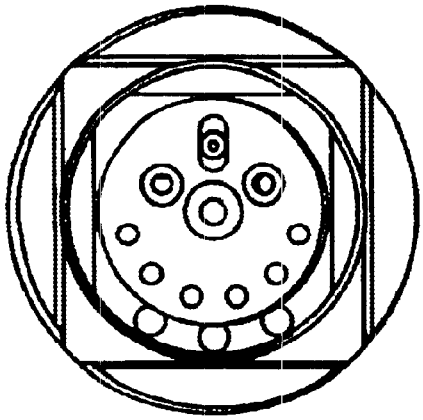
FIG 7 PRIOR ART
FIG. 7 is a front view of the body of a device of the prior art.

As compared to the prior art as shown in FIG. 7, it is clear that the slots have a much greater volume (as much as 50% greater) than the plurality of separate holes for the fan air and the atomizing air.

Figure 36:
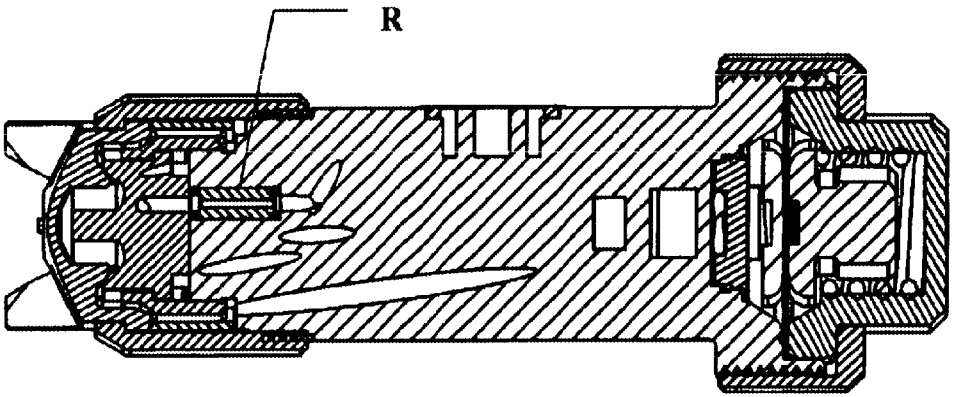
FIG 36 PRIOR ART
FIG. 36 is a cross-section view of prior art showing the restrictor.

A pneumatically controlled regulator, separate from the device, (not shown) controls the flow of paint into the device through a paint inlet 56 which is formed on the upper surface of the body 12 and is connected to a paint duct 58 within the body 12. The paint duct 58 terminates at the first end of the body at an outlet 60. A restrictor 62 is disposed in the outlet 60 so that a portion of the restrictor 62 extends outwardly from the face of the body 12 and may be manually removed or inserted into the outlet. Thus, the restrictor is easily accessible for replacement or servicing as contrasted to prior art where the restrictor R is usually located deeper within the atomizer (FIG. 36).

Figure 10:
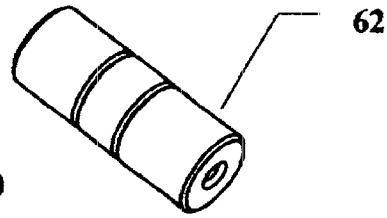
FIG. 10 is a perspective view of the restrictor.
Figure 12:
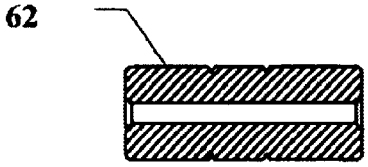
FIG. 12 is a cross-section view taken across the lines 12—12 of FIG. 11.
Figure 11:
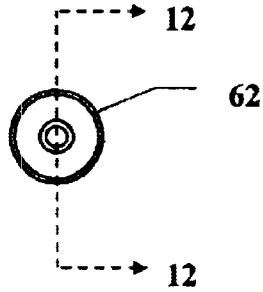
FIG. 11 is an end view of the restrictor.
Figure 13:
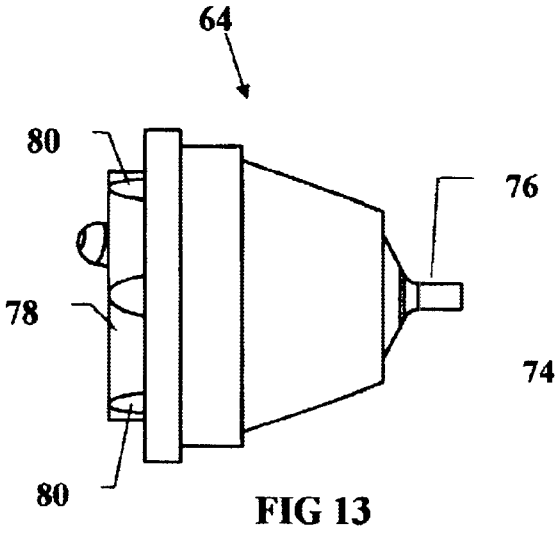
FIG. 13 is a side elevation view of the nozzle.
Figure 14:
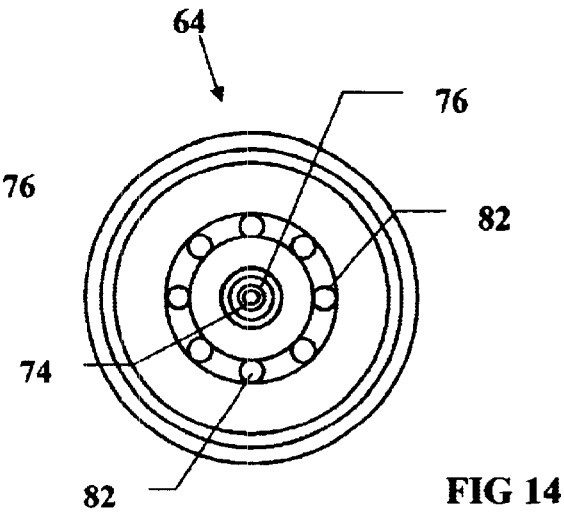
FIG. 14 is a front view of the nozzle.
Figure 15:
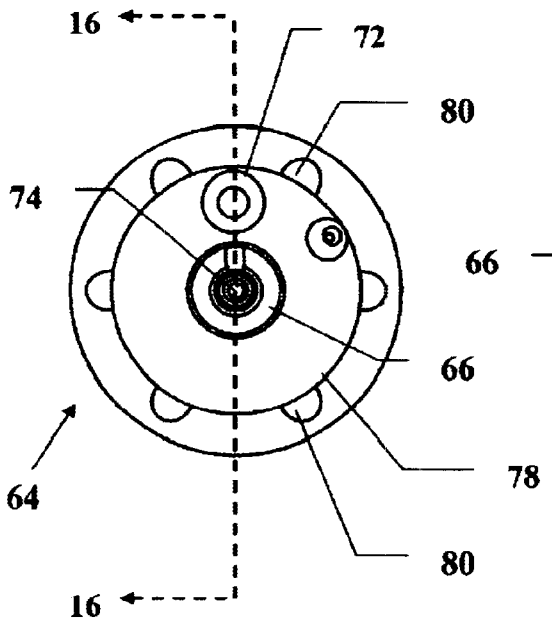
FIG. 15 is a rear view of the nozzle.
Figure 16:
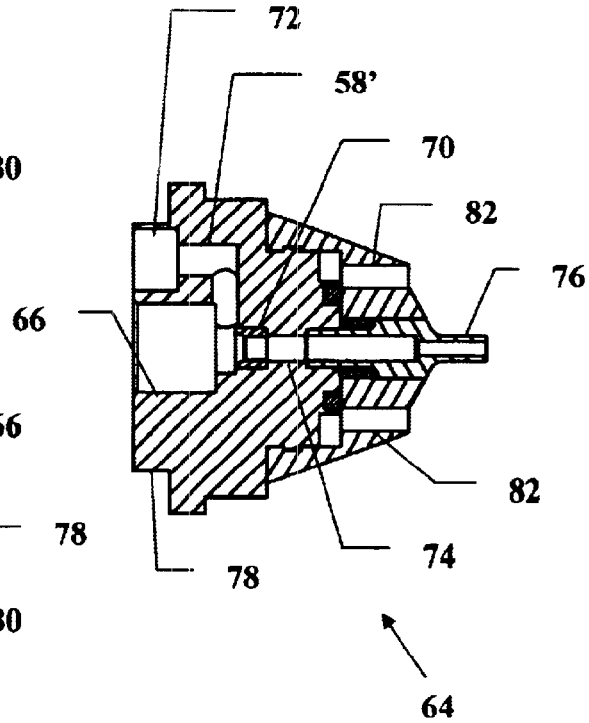
FIG. 16 is a cross-section view taken across the lines 16—16 of FIG. 15.

As shown in FIGS. 10–12, the restrictor is a cylinder with a center bore and may have annular grooves formed on the exterior of the cylinder for bore size identification. The restrictor generates a paint "back pressure" which must be maintained for the regulator to function properly. The outwardly extending portion of the restrictor 62 is received in the nozzle 64 and the paint is directed to the end of the needle valve 44, as will be described.

The nozzle 64, as shown in FIGS. 13–16, is disposed with the back end of the nozzle abutting the first end of the body 12. The back end of the nozzle has a center opening 66 therein which receives a sleeve 68 with an O-ring to seal the sleeve within the opening 66. The sleeve has a center bore through which the needle valve 44 extends. The rounded end of the needle valve 44 is seated against a tapered shoulder 70 in the opening 66. A further opening 72 is formed in the back end of the nozzle 64 in which the outwardly extending portion of the restrictor 62 is received. A paint duct 58' directs the paint to a point immediately rearward of the tapered shoulder 70 in the opening 66. When the trigger air is introduced into the body 12 and the cartridge is activated, the needle valve 44 is moved in the direction of the end cap on the cartridge and the tip is unseated from the tapered shoulder 70. The paint then flows into a smaller diameter bore 74 and out the tip 76 in the front of the nozzle 64 (P with arrow).

Figure 17:
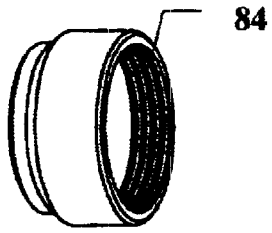
FIG. 17 is a perspective view of the nozzle nut.
Figure 19:
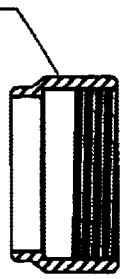
FIG. 19 is a cross-sectional view taken across the lines 19—19 of FIG. 18.
Figure 18:
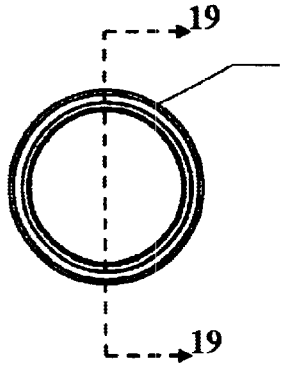
FIG. 18 is an end view of the nozzle nut.
Figure 20:
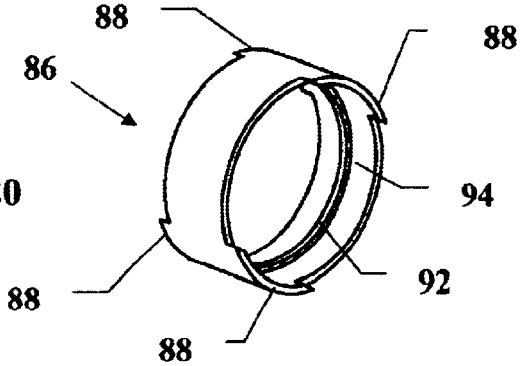
FIG. 20 is a perspective view of the guide ring.
Figure 23:
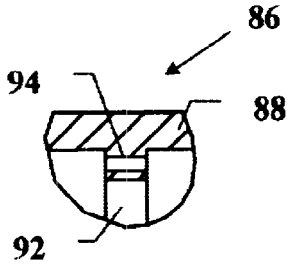
FIG. 23 is a greatly enlarged detail view of a portion of FIG. 22.
Figure 22:
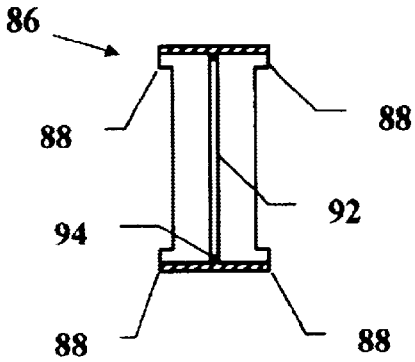
FIG. 22 is a cross-sectional view taken across the lines 22—22 of FIG. 21.
Figure 21:
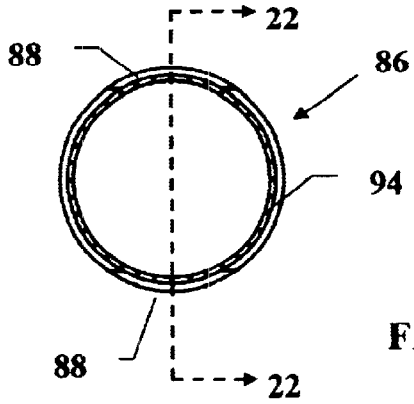
FIG. 21 is an end view of the guide ring.
Figure 26:
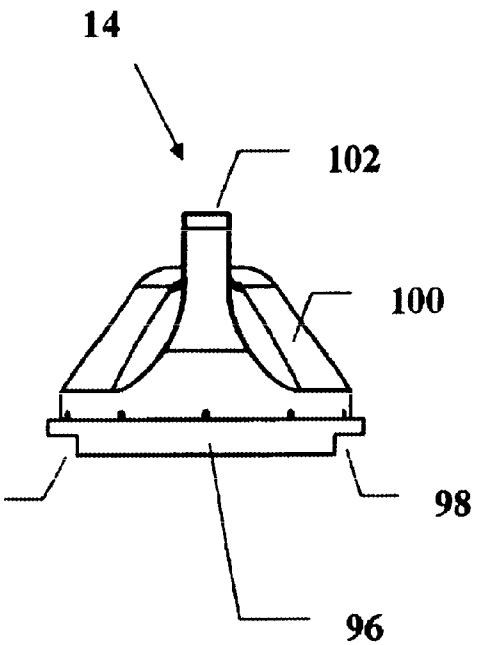
FIG. 26 is a side elevation view of the air cap.
Figure 25:
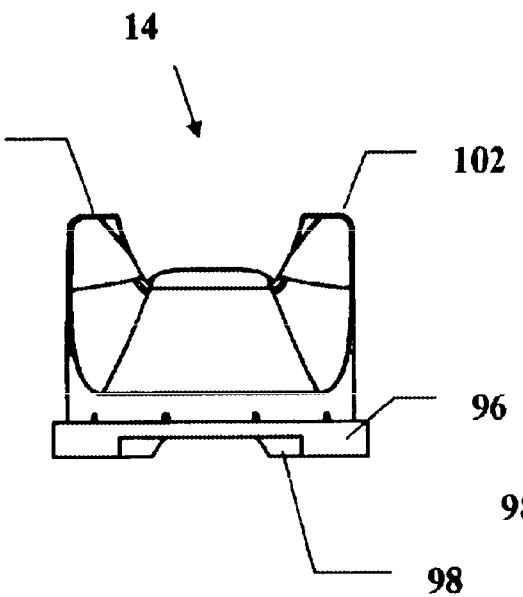
FIG. 25 is a front elevation view of the air cap.
Figure 24:
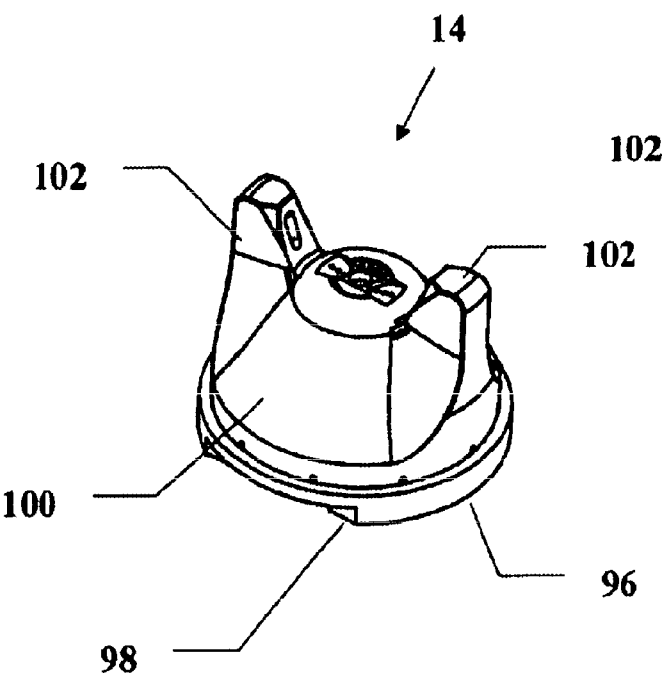
FIG. 24 is a perspective view of the air cap.
Figure 27:
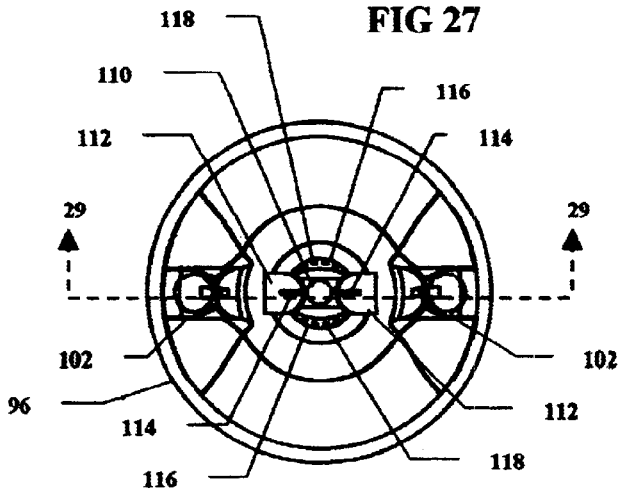
FIG. 27 is a top plan view of the air cap.
Figure 28:
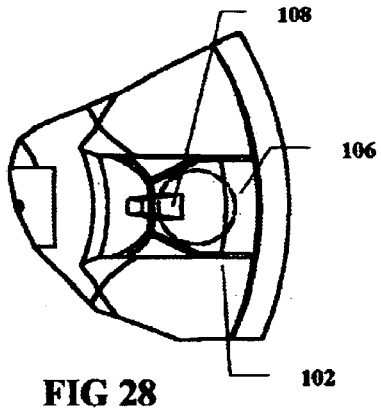
FIG. 28 is an enlarged view of the horn of the air cap showing the tapered slot for the fan air to exit the opening in the horn.
Figure 29:
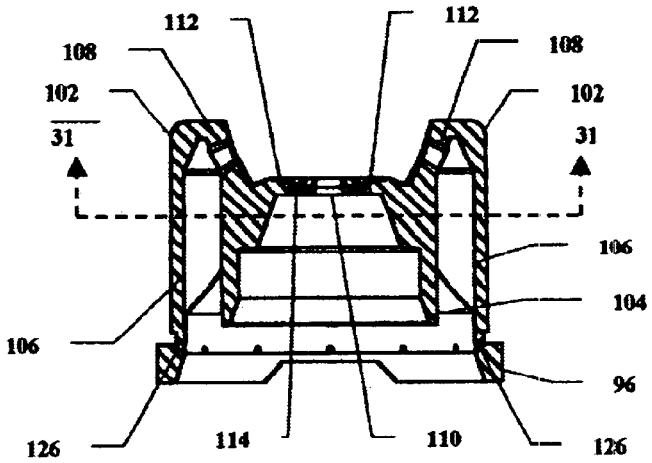
FIG. 29 is a cross-sectional view taken across the lines 29—29 of FIG. 27.
Figure 30:
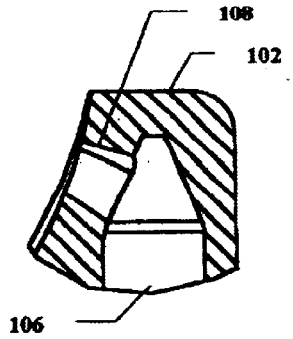
FIG. 30 is an enlarged view of the passageway for fan air in the horn connecting to the tapered slot for fan air to exit the opening in the horn.
Figure 31:
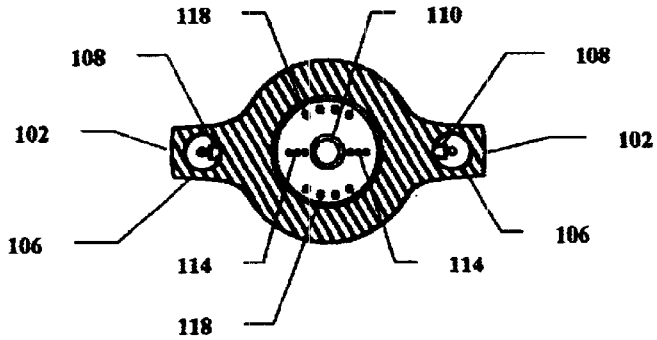
FIG. 31 is a cross-sectional view taken across the lines 31—31 of FIG. 29.

The back end of the nozzle 64 is formed with a boss 78 which has a diameter smaller than the largest diameter portion of the nozzle 64. A plurality of spaced-apart vents 80 are formed about the periphery of the boss 78 and are connected via internal ducting to a chamber which has ducts to a plurality of spaced-apart openings 82 on the front of the nozzle 64 concentrically about the tip 76. Alternately, the ducting may be directly from the vents 80 to the openings 82. The first end of the body 12 has external threads formed thereon. A nozzle nut 84, as shown in FIGS. 17–19, has threads formed internally in the larger diameter front portion which cooperate with the threads on the first end of the body 12. The smaller diameter second portion of the nozzle nut 84 forms a seal against the largest diameter portion of the nozzle 64. With the nozzle nut 84 securing the nozzle 64 to the first end of the body 12, the atomizing air from the ducts 52 in the body 12 is directed into the vents 80, through the nozzle 64 and out of the openings 82.

A cylindrical guide ring 86, as shown in FIGS. 20–23, is disposed on the first end of the body 12 and is concentric around the nozzle nut 84. Each end of the guide ring 86 has a pair of diametrically-opposed projections 88 formed thereon. The first end of the body 12 has a pair of diametrically-opposed non-arcuate surfaces 90 formed thereon (FIG. 6). The projections 88 on one end of the guide ring 86 are disposed adjacent to the non-arcuate surfaces 90 such that the guide ring 86 is prevented from rotating in either direction about the end of the body 12 due to contact between the projections 88 and the non-arcuate surfaces 90. A baffle flange 92 is formed annularly about the inner circumference of the guide ring 86. The baffle flange 92 has a plurality of spaced-apart openings 94 formed therethrough. When the guide ring 86 is disposed on the first end of the body 12, the exits for the ducts 51, 50' for the fan air are directed internally of the guide ring 86. All of the fan air is thereby directed through the openings 94 in the baffle flange 92 and is distributed evenly throughout the guide ring 86 on the portion of the guide ring which is distal from the body and proximal to the air cap 14.

The air cap 14, as shown in FIGS. 24–31, is juxtapositioned to the guide ring 86 and over the nozzle 64. The air cap 14 has an annular base 96 with two opposite non-arcuate segments 98. Formed on the base 96 is a frustoconical body 100 with opposing horns 102. Interiorly of the frustoconical body 100, there is formed a cylindrical member 104. The air cap 14 is seated over the nozzle 64 such that the inner walls of the frustoconical body 100 cooperate with the outer surface of the nozzle 64. The projections 88 on the guide ring 86 are received in the non-arcuate segments 98 of the base 96 of the air cap 14 which prevent rotation of the air cap 14 and also direct the fan air around the periphery of the interior of the air cap 14 and exteriorly of the cylindrical member 104 within the air cap. A passageway 106 is formed in each horn 102 which connects with at least one tapered air slot 108. The slot 108 is conical and has a larger area inside the horn 102 and a smaller area at the exit from the horn 102. The exiting fan air is directed forwardly and toward the center of the air cap 14 to assist in forming a desired paint spray pattern.

The air cap 14 further has an opening 110 formed centrally between the horns 102. The nozzle tip 76 is received in this opening 110 such that the nozzle tip 78 extends slightly outwardly of the opening 110. Two depressions 112 are formed on the top of the air cap 14, one on each side of the opening 110 oriented toward the respective horns 102 and angled upwardly toward the respective horns 102. A plurality of spaced-apart holes 114 are formed linearly in each depression 112. Two arcuate depressions 116 are formed on the top of the air cap 14, approximately at 90° with respect to the other depressions 112. Each arcuate depression 116 is deeper proximal to the opening 110 and tapers upwardly toward the surface of the air cap 14 distal from the opening 110. A plurality of spaced-apart holes 118 are formed in each arcuate depression 116. The atomizing air directed out of the openings 82 in the front of the nozzle 64 is channeled by the cylindrical member 104 within the air cap 14 to the holes 114 and 118 in the top of the air cap 14. The number and orientation of the holes 114, 118 determine a desired flow of atomizing air which strikes the paint which exits the nozzle tip 76 and influences the paint spray pattern.

Figure 32:
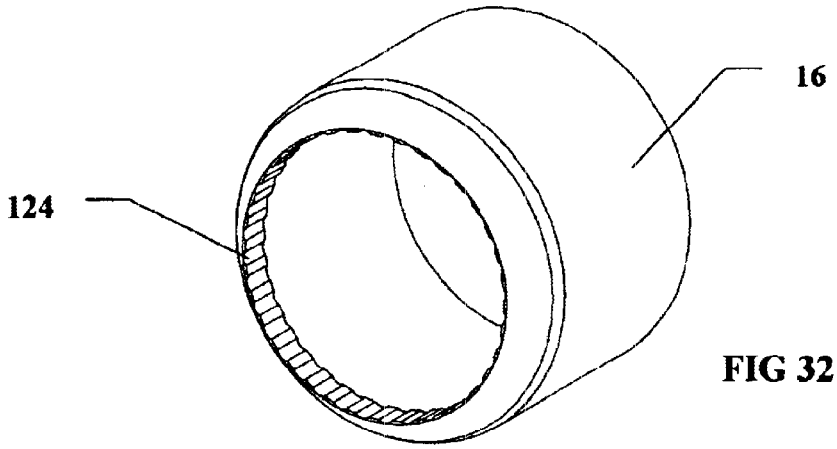
FIG. 32 is a perspective view of the air cap nut.

An air cap nut 16 which has internal threads at one end and an internal shoulder 122 at the other end is disposed over the air cap 14 (FIG. 32). The internal threads cooperate with external threads near the first end of the body 12 and, when completely threaded together, the internal shoulder 122 in the air cap nut 16 abuts the top of the base 96 of the air cap 14. The inner circumference of the internal shoulder of the air cap nut 16 has formed therein a plurality of spaced-apart longitudinal compensation passages 126 formed in the air cap 14 immediately adjoining the base 96. A small portion of the fan air passes through these compensation passages 126 and through the compensation slots 124 in the air cap nut 16. This "compensation air" flows in the direction of horns 102 and the tip of the nozzle 110 over the outer surface of the air cap 14. The compensating air gently forces the paint or coating material away from the device and toward the target being coated and also assists in preventing the paint or coating material from tracking back over the spray device 10.

Figure 33:
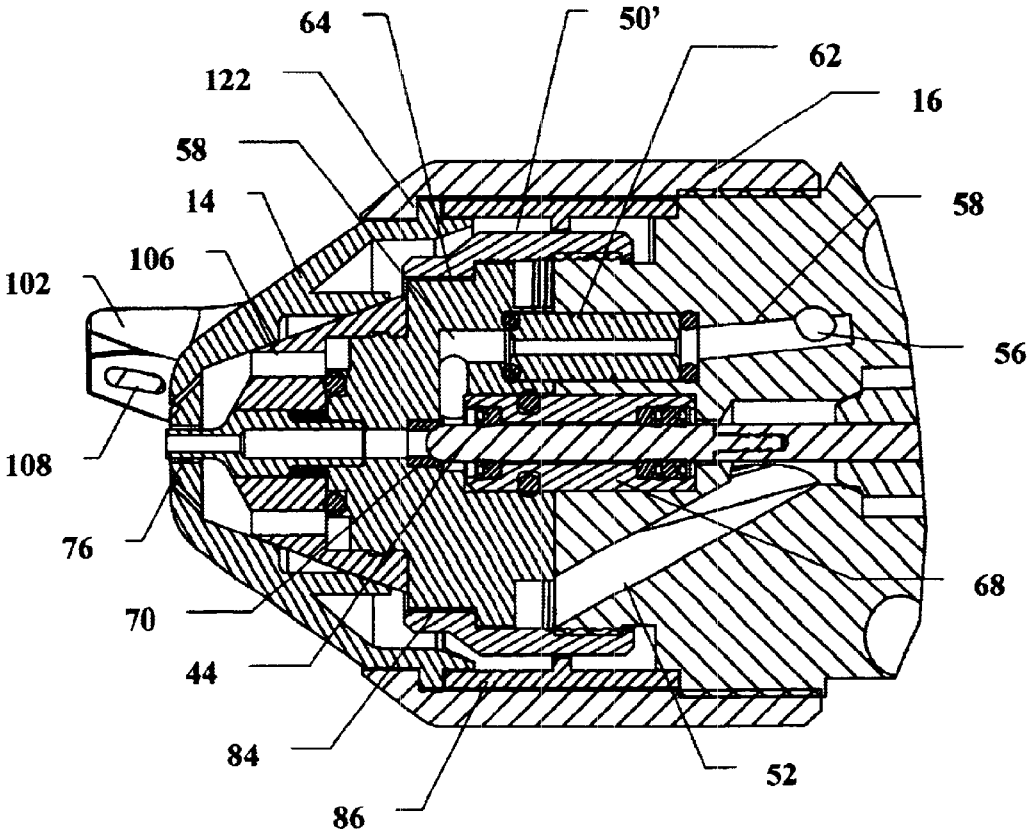
FIG. 33 is a cross-sectional view taken across the lines 33—33 of FIG. 6.
Figure 34:
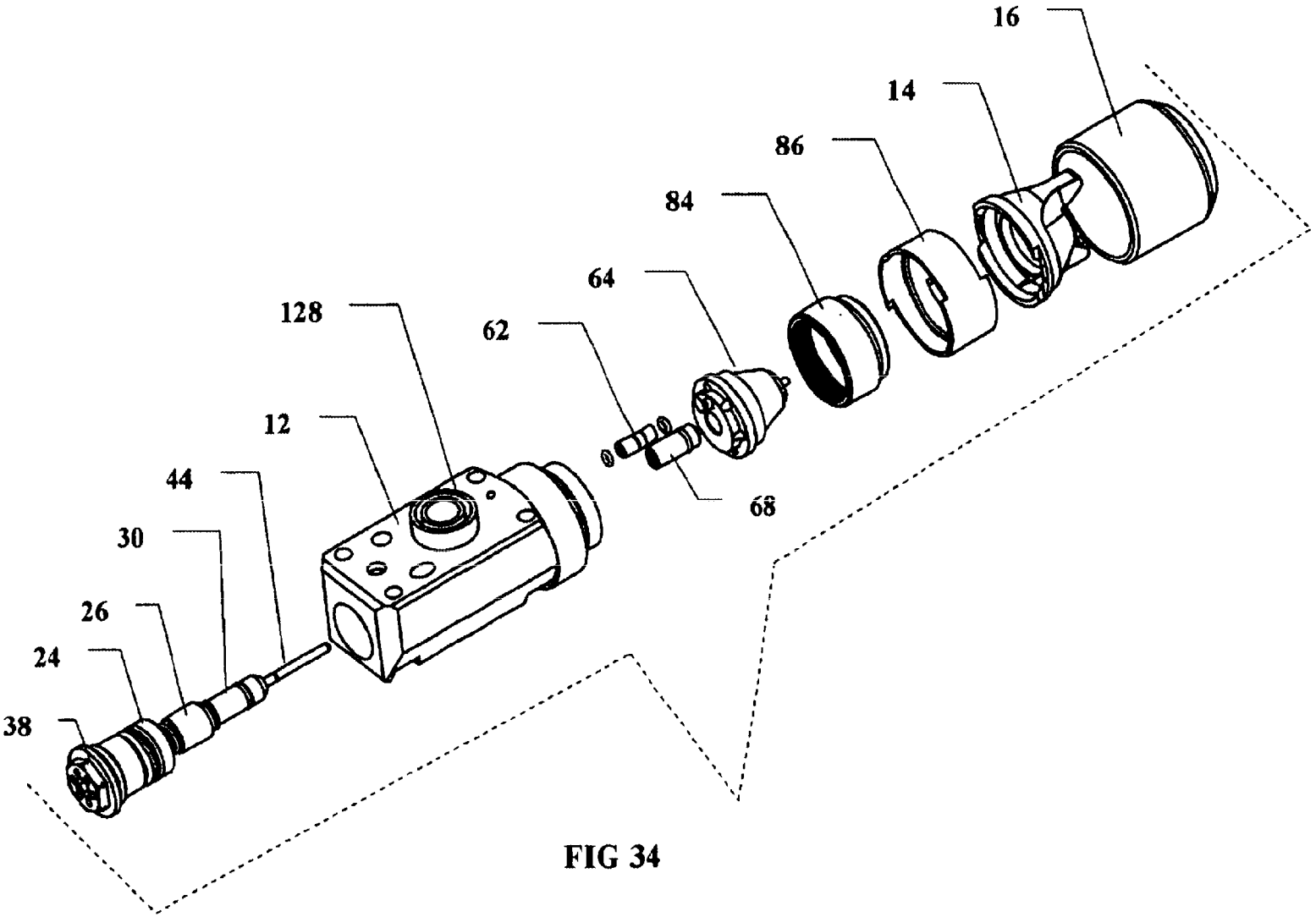
FIG. 34 is an exploded view of the device of the present invention.

The first end of the body 12, the mounting of the guide ring 86, nozzle 64, air cap 14 and air cap nut 16 are further shown in FIG. 33. The assemblage of the components is shown in FIG. 34.

Figure 3:
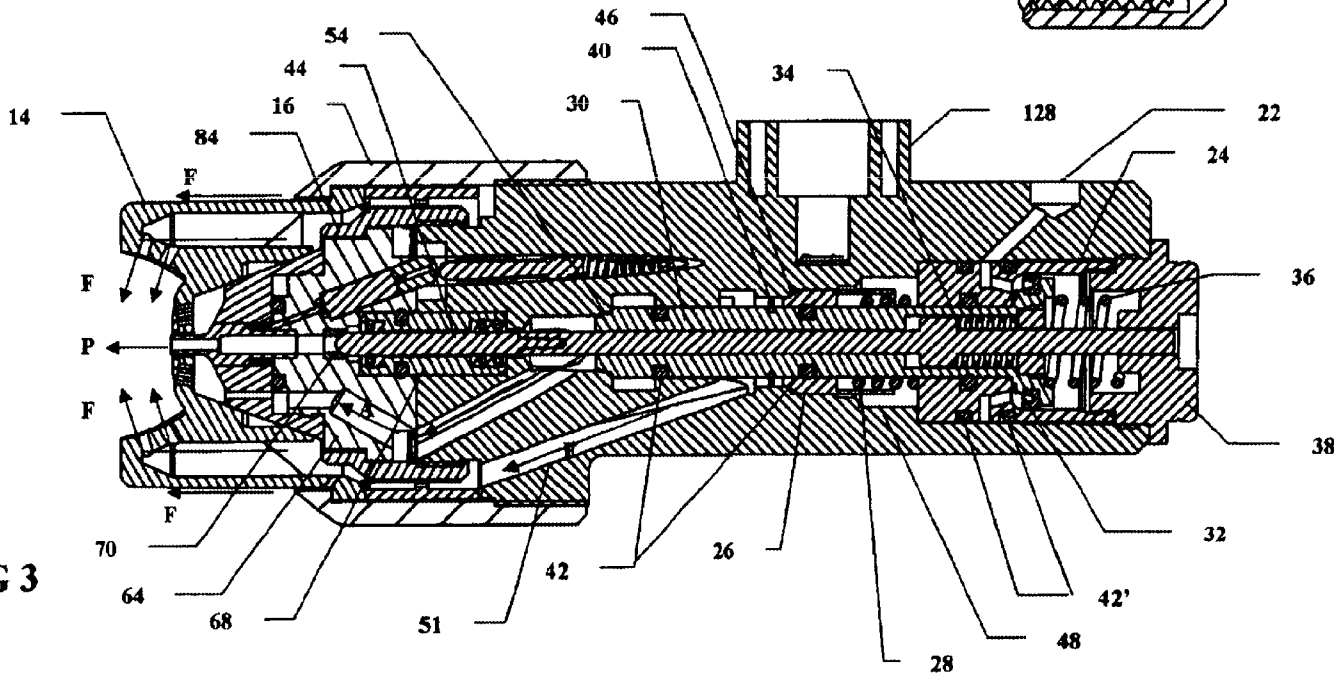
FIG. 3 is a cross-section view of the present invention taken across the lines 3—3 of FIG. 1.

The device of the present invention may be used in the electrostatic spraying of paint. A source of high voltage is connected to the body 12, and electrically through the body to nozzle. FIG. 3 shows the charging path through the atomizer body and nozzle assembly.

The electric current tends to leak and track across surfaces and, in prior art, isolation rings are formed about the connection between the device and the power source connector. Corresponding separate ring pieces are provided to fit into the isolation rings. The present invention has incorporated male and female radiation rings 128 integrally into the body 12 of the device, eliminating the need for separate ring pieces.

Figure 2:
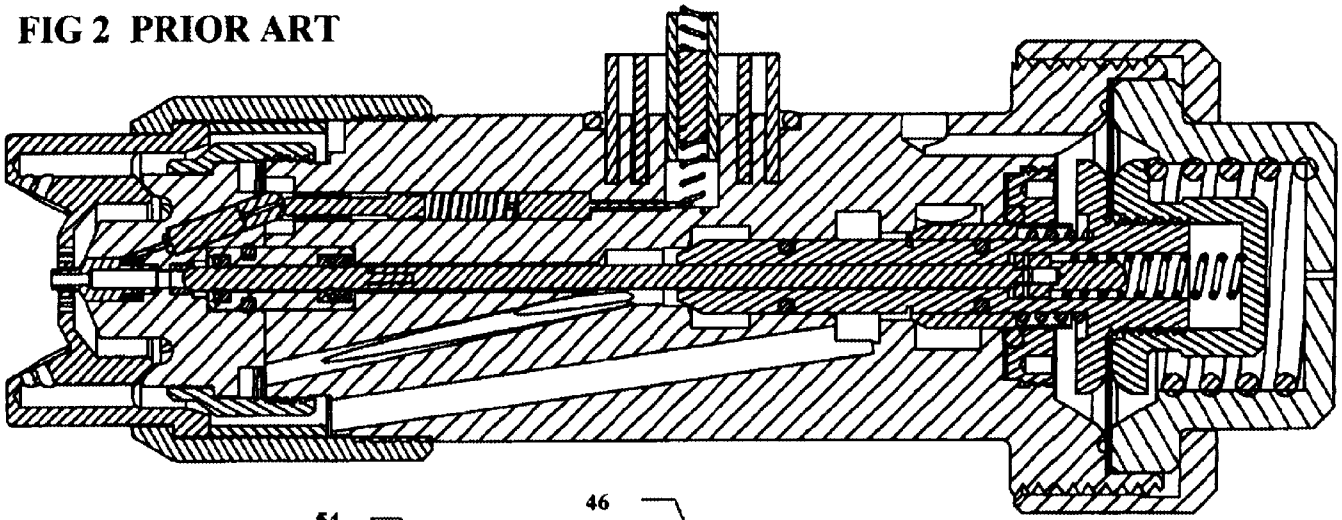
FIG 2 PRIOR ART
FIG. 2 is a cross-section view of a device of the prior art.

The present invention uses the spring-activated cartridge in place of the valve diaphragm used in the prior art as shown in FIG. 2. The present invention overcomes one of the problems associated with the diaphragm which was separation of the two components from which the diaphragm was constructed.

In the present invention, the spring-energized cup seal replaces the diaphragm. The cup seal 32 preferably is formed from a fluorinated hydrocarbon (e.g., Teflon) which has excellent chemical resistance to solvents. Furthermore, the cartridge is a single unit which can be easily replaced if required simply by unthreading the end cap 38 from the body 12 and sliding out the cartridge.

The present invention also includes a restrictor 62 for paint flow within the device. The restrictor 62 is easily removable and readily accessible.

The ducting in the body of the device of the present invention exits from the body in wedge-shaped ducts 50, 52 which are in the form of slots. This provides a significant increase in volume over the circular orifices of the prior art.

A guide ring 86 in the device has an internal baffle flange 92 with a plurality of spaced-apart openings 94 which distribute the fan air more evenly than the prior art.

The exiting fan air holes in the horns 102 of the air cap 14 have been formed with a slot 108 that is conical in cross-section and have an increased cross-sectional area. This increases the amount of fan air volume leaving the air cap 14 and decreases the air pressure.

The air cap nut 16 has compensating passages 124 which direct fan air over the air cap 14 and assists in providing an improved coating on the target.

Isolation rings 128 are formed integrally into the body eliminating the need for separate isolation ring pieces.

Figure 35:
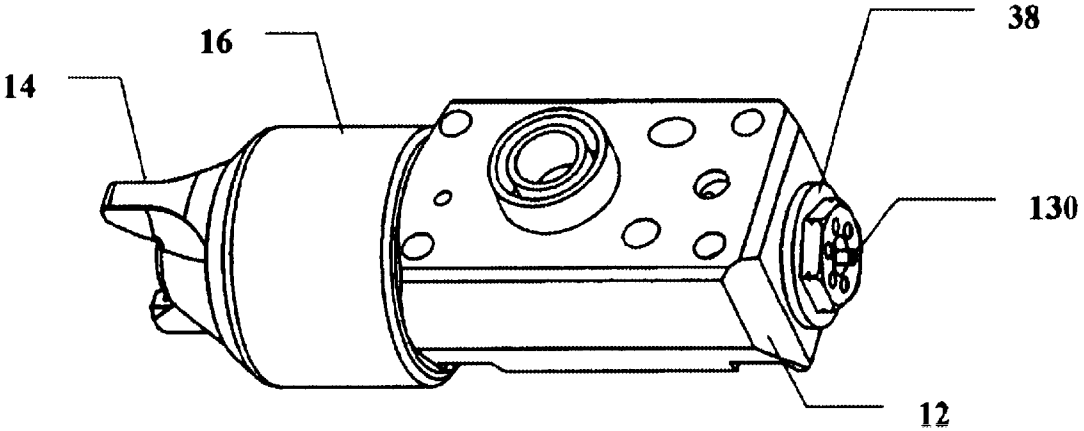
FIG. 35 is a perspective view showing the indicator means protruding from the end cap.

An additional feature of the present invention is an indicator means 130 connected to the end of the piston 26 near the end cap 38 at the second end of the body 12. Preferably, the indicator means 130 is a pin having a color different from the color of the end cap 38. When the trigger air is supplied to the device, the piston 26 moves toward the second end of the body 12 and the indicator means 130 protrudes from the second end of the body 12 (FIGS. 3 and 35). This protrusion provides both a visual and a tactile indication that the device has been triggered.

As a result of the above-described features, the device of the present invention is more compact than devices of the prior art and allow greater accessibility into confined spaces. This is especially important when the device is attached to a robot arm and not operated manually but is operated externally of the device.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A device for spraying paint comprising:

a body having a first end and an opposite second end, a nozzle being attached to the first end of the body, a trigger air inlet, a fan air inlet and an atomizing air inlet formed in the body, all of the air inlets being spaced apart from one another, means for independently introducing fan air and atomizing air from external sources into the respective fan air inlet and atomizing air inlet, trigger air from an external source being introduced into the trigger air inlet, for controlling the flow of paint, fan air and atomizing air through the device, at least one slot for the atomizing air and at least one slot for the fan air formed in the body for exiting of the respective atomizing air and fan air from the first end of the body such that low pressure air is applied to the paint and high volume atomized paint is provided by the device.

2. The device of claim 1, further comprising a triggering means disposed in a center bore in the body, the triggering means being a replaceable cartridge having at least one piston, a needle valve and at least one spring, wherein activation of the triggering means opens a plurality of valves to introduce paint, atomizing air and fan air into the device.

3. The device of claim 1, further comprising a guide ring disposed around the nozzle, the guide ring having a baffle flange formed annularly about an inner circumference thereof, a plurality of spaced-apart baffle openings formed through the baffle flange and communicating with the at least one fan slot, wherein fan air exiting the device is evenly distributed.

4. The device of claim 1, further comprising an air cap connected to the first end of the body and covering the nozzle, the air cap having two opposing fan air slots formed therein for exiting of fan air from the device, the fan air slots each being conical in cross section thereby decreasing air pressure and increasing volume and such that the fan air is directed at the atomized paint to form a desired pattern of paint spray from the device.

5. The device of claim 1, further comprising an outer and an inner isolation ring disposed on an outer surface of the body, said rings being integral members of the body.

6. The device of claim 1, wherein an electric voltage is applied to the device such that the paint is electrostatically charged, an outer isolation ring and a concentric inner isolation ring being formed integrally on the body of the device to reduce voltage leakage over the body of the device.

7. The device of claim 1, wherein the device is robot-mounted and operated externally of the device.

8. The device of claim 1, wherein the at least one slot for atomizing air and the at least one slot for fan air are wedge shaped.

9. The device of claim 1, further comprising an air cap disposed on the first end of the body covering the nozzle, an air cap nut securing the air cap to the body, the device having means for directing a portion of the fan air between the air cap nut and an the air cap such that fan air passes over the outer surface of the air cap and assists in directing the paint spray.

10. The device of claim 9, wherein a plurality of spaced-apart passages are formed in the air cap and a plurality of spaced-apart longitudinal slots are formed in one end of the air cap nut, the fan air passing from the passages and through the slots.

11. A device for spraying paint comprising:

a body having a first end and an opposite second end, a nozzle being attached to the first end of the body, means for introducing fan air and atomizing air into the body, means for controlling the flow of paint through the device, at least one slot for the atomizing air and at least one slot for the fan air formed in the body for exiting of the respective atomizing air and fan air from the first end of the body such that low pressure air is applied to the paint and high volume atomized paint is provided by the device, further comprising a restrictor to generate back pressure to the flow of paint, the restrictor being disposed partially within the body and partially within the nozzle, wherein the restrictor is accessible for ease of removal and replacement.

12. In a device for spraying paint having a body connected to a nozzle, an air cap covering the nozzle, an air cap nut securing the air cap to the body, means for controlling the flow of paint atomizing air and fan air through the body, an improvement comprising:

means for directing a portion of the fan air between the air cap and the air cap nut such that fan air passes over an outer surface of the air cap and assists in directing the paint spray.

13. The device of claim 12, wherein a plurality of spaced-apart passages are formed in the air cap and a plurality spaced-apart compensation slots are formed in one end of the air cap nut, the fan air passing from the passages and through the compensation slots.

14. The device of claim 12, further comprising the air cap having two horns formed thereon, a portion of the fan air being directed into such horn, a slot being formed in each horn such that the slots are opposed to one another, each slot having conical cross-section thereby decreasing air pressure and increasing volume such that fan air is directed at the paint to form a desired pattern of paint spray from the device.

15. The device of claim 12, further comprising a guide ring disposed around the nozzle, the guide ring having plurality of spaced-apart baffle openings formed circumferentially therein and communicating with the at least one fan slot, wherein fan air exiting the device is evenly distributed.

16. A device for spraying paint comprising:

a body having a first end and an opposite second end, a single control means for introducing paint, fan air and atomizing air into the body, the single control means being a replaceable cartridge being disposed in a center bore in the body, the cartridge having at least one piston, a needle valve, and at least one spring, wherein activation of the at least one spring moves the needle valve and the at least one piston simultaneously to introduce paint, atomizing air and fan air into the device.

17. The device of claim 16, further comprising:

at least one slot for the atomizing air and at least one slot for the fan air formed in the first end of the body for exiting of the respective atomizing air and fan air from the first end of the body such that low pressure air is applied to the paint and high volume atomized paint is provided by the device.

18. The device of claim 16, further comprising an indicator means connected to the at least one piston, wherein when the at least one spring is activated, the at least one piston moves toward the second end of the body, the indicator mans protruding from the second end of the body and providing a visual and a tactile indication.

19. A device for spraying paint comprising:

a body having a first end and an opposite second end, means for introducing fan air and atomizing air into the body, a replaceable cartridge being disposed in a center bore in the body, the cartridge having at least one piston, a needle valve, and at least one spring, wherein activation of the at least one spring moves the needle valve and the at least one piston to introduce paint, atomizing air and fan air into the device, further comprising an inner piston received within an outer piston, each piston having a respective tapered end, each tapered end being seated against a respective shoulder in the bore in the body, thereby forming a respective seal, and wherein activation of the at least one spring unseats each of the pistons to admit atomizing air and fan air into the device.

* * * * *